US010124388B2

(12) United States Patent
Köstermeier

(10) Patent No.: US 10,124,388 B2
(45) Date of Patent: Nov. 13, 2018

(54) DEVICE AND METHOD TO SHAPE WORKED PIECES

(75) Inventor: Karl-Heinz Köstermeier, Rheda-Wiedenbrück (DE)

(73) Assignee: Repkon Machine and Tool Industry and Trade, Inc., Istanbul (TR)

( * ) Notice: Subject to any disclaimer, the term of this patent is extended or adjusted under 35 U.S.C. 154(b) by 688 days.

(21) Appl. No.: 13/521,298

(22) PCT Filed: Jan. 7, 2011

(86) PCT No.: PCT/EP2011/000035
§ 371 (c)(1),
(2), (4) Date: Jul. 10, 2012

(87) PCT Pub. No.: WO2011/085948
PCT Pub. Date: Jul. 21, 2011

(65) Prior Publication Data

US 2012/0285215 A1 Nov. 15, 2012

(30) Foreign Application Priority Data

Jan. 12, 2010 (EP) ..... 10000210

(51) Int. Cl.

| | |
|---|---|
| ***B21D 22/16*** | (2006.01) |
| ***B21B 17/04*** | (2006.01) |
| ***B21B 23/00*** | (2006.01) |
| ***B21B 17/06*** | (2006.01) |
| ***B21B 17/08*** | (2006.01) |
| ***B21B 17/02*** | (2006.01) |
| ***B21B 37/16*** | (2006.01) |

(52) U.S. Cl.
CPC ..... *B21D 22/16* (2013.01); *B21B 17/02* (2013.01); *B21B 17/04* (2013.01); *B21B 17/06* (2013.01); *B21B 17/08* (2013.01); *B21B 23/00* (2013.01); *B21B 37/16* (2013.01)

(58) Field of Classification Search
CPC ..... B21D 22/16; B21B 17/02; B21B 17/04; B21B 17/06; B21B 17/08; B21B 23/00; B21C 37/15; B21C 37/155; B21C 37/16
USPC ..... 72/208
See application file for complete search history.

(56) References Cited

U.S. PATENT DOCUMENTS

| | | | | |
|---|---|---|---|---|
| 2003/0046803 | A1 | 3/2003 | Kaneko | |
| 2008/0314113 | A1* | 12/2008 | Minoguchi | 72/370.06 |
| 2009/0288464 | A1* | 11/2009 | Kostermeier | B21D 22/16 72/84 |

FOREIGN PATENT DOCUMENTS

| | | |
|---|---|---|
| DE | 2007002228 | 7/2008 |
| GB | 2184676 | 7/1987 |

OTHER PUBLICATIONS

International Preliminary Report for PCT Application PCT/EP2011/0000035, EPO, Aug. 7, 2012.
International Search Report for PCT Application PCT/EP2011/0000035, EPO, dated Apr. 15, 2011.

* cited by examiner

*Primary Examiner* — David B Jones

(57) ABSTRACT

A device to process a blank (3) that includes at least one outer shaping tool (8) that may be radially positioned or radially displaced. An inner shaping tool (9) is mounted co-axially to the main machine axis (x) of the main spindle (1.1). The inner shaping tool (9) may be axially displaced and/or axially positioned with respect to the axial position of the outer shaping tools (8).

7 Claims, 6 Drawing Sheets

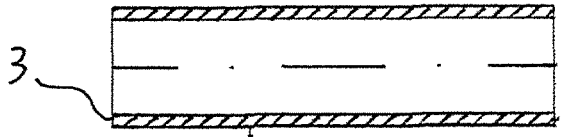
Fig. 4
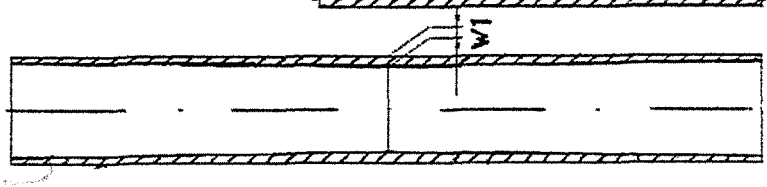
Fig. 5
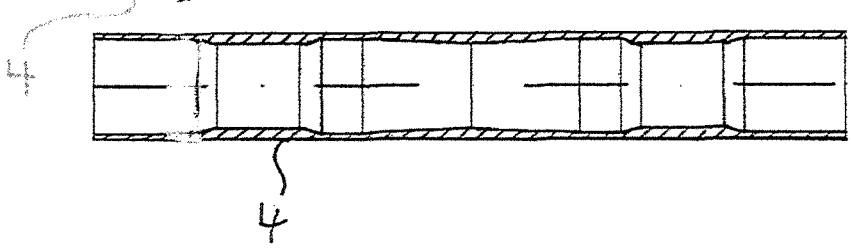
Fig. 6
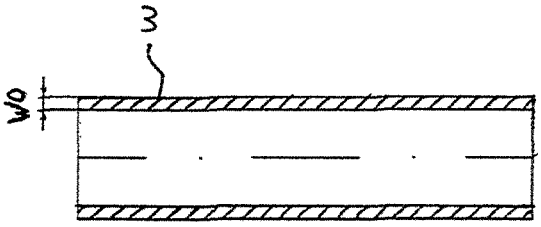
Fig. 7
Fig. 8
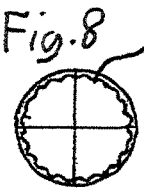
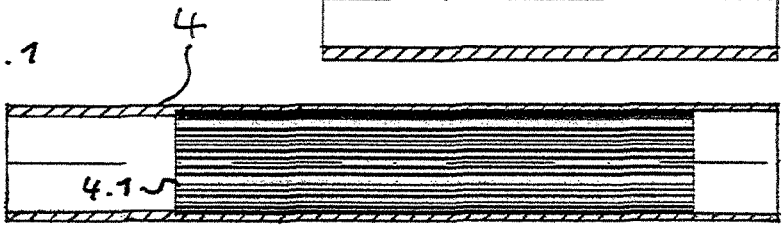
Fig. 9
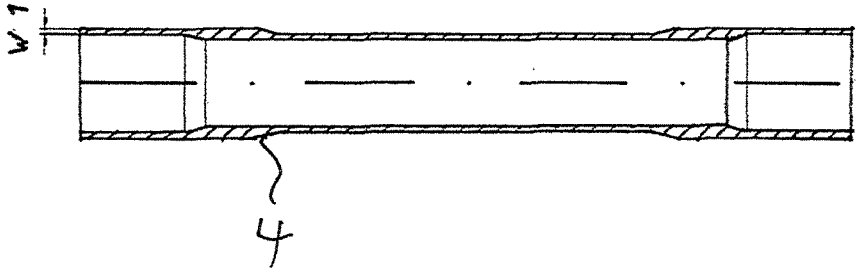
Fig. 10

DEVICE AND METHOD TO SHAPE WORKED PIECES

TECHNICAL FIELD

The invention relates to a device to shape worked pieces and more particularly to a device and method whereby an inner shaping tool (9) is mounted co-axially with a main machine axis (x) of a main spindle (1.1) that may be axially positioned and/or displaced with respect to an axial position of the at least one outer shaping tool (8).

BACKGROUND INFORMATION

Methods are known in which a worked piece is displaced by rotation and is then shaped from without by means of rollers or cylinders placed into contact with the worked piece. These worked pieces are often in the form of rotation-symmetrical hollow bodies. These hollow bodies may include floors closed from one side.

In most cases, this shaping is performed in a manner such that the outer shaping cylinders press the casing of the hollow-body shaped worked piece against an inner mandrel so that the material is placed into a shaping zone between the shaping-tool axially, radially, and tangentially to its rotation. This reduces the wall thickness of the casing.

The hollow body to be shaped is thus placed throughout its entire length onto the inner mandrel such that at least 50% of the finished worked piece is located on the inner mandrel after shaping. Dependent on the process, 100% of the length of the worked piece may be located on the inner mandrel.

Pressing the material against the inner mandrel during shaping includes the disadvantage that a high amount of friction arises between the inner surface of the worked piece and the surface of the mandrel. This friction leads in turn to disadvantageous heating of worked piece and inner mandrel. Also, wear to the surface occurs during the shaping process because of the friction load.

Furthermore, the ideal outer diameter of the inner mandrel must be determined experimentally, which requires time-consuming subsequent correction to the outer diameter of the inner mandrel. The option of manufacturing worked pieces with various inner diameters with various wall thicknesses within a worked piece by means of an inner mandrel is excluded. Production of such worked pieces requires a multi-piece inner mandrel, with parts attached to the main spindle and to the tailstock spindle. Such a device with a multi-part inner mandrel is expensive, however. Additionally, the potential contour of the worked piece is also limited in that a multi-part inner mandrel allows for only limited space provided for shaping the interior of the worked piece to be shaped.

SUMMARY

The task of the invention is to present a method that allows shaping of rotation-symmetrical worked pieces with constant but various wall thickness for varying outer and inner dimensions, and a device to perform this method, for which the above-mentioned disadvantages are partially or totally abolished.

The device based on the invention possesses an internal shaping tool that may be rotated about the main machine axis and is mounted coaxially with the main machine axis.

The internal shaping tool is attached to a bracket that may be displaced along the axial longitudinal direction. This bracket may be mounted so that it may rotate together with, or independent of, the internal shaping tool.

A number of external shaping cylinders that may be displaced and positioned dependent on a prescribed worked piece shape engage the casing surface of the blank in the area of the internal shaping tool. The blank is accepted by a receptacle that simultaneously includes a centering device that also centers the blank.

A distinguishing characteristic of the device is that the internal shaping tool is provided with an exterior contour that allows definition of the axial position of the shaping zone on the internal shaping tool based on the axial positioning of the external shaping tools relative to the internal shaping tool, and thus the definition of the inner diameter of the worked piece by means of the relative axial position of the external and the internal shaping tools based on the contour of the internal shaping tool. In addition to the inner worked piece diameter, the radial positioning capability of the external shaping tools also allows definition of the outer worked piece diameter and thus the wall thickness at every point along the main machine axis x.

BRIEF DESCRIPTION OF THE DRAWINGS

In the following, the invention will be described using Figures, which show:

FIGS. 4-10 are a schematic view of potential shapes of blank and worked pieces;

DETAILED DESCRIPTION OF THE INVENTIONS

Figure 1:
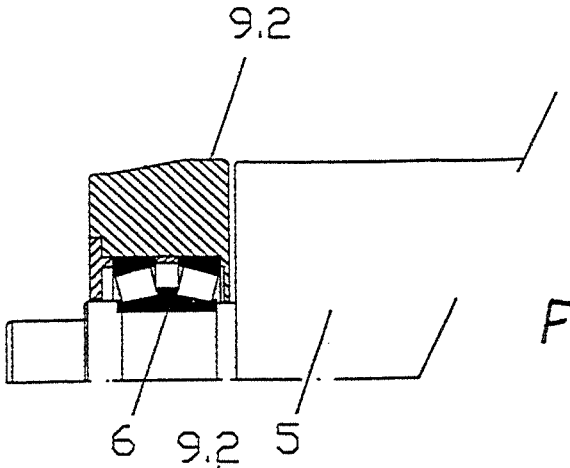
FIGS. 1-3 are a schematic view of three embodiment examples of the inner shaping tool.
Figure 2:
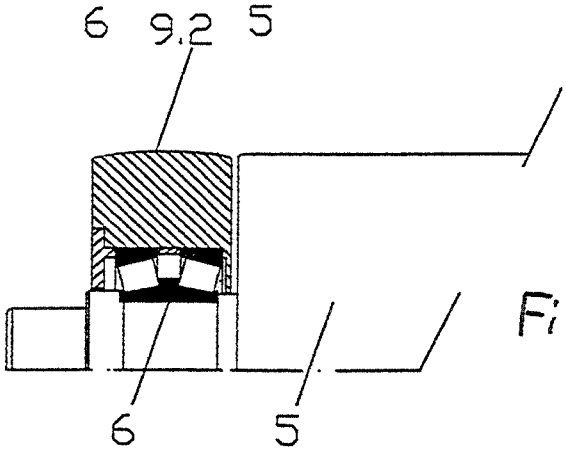
Figure 3:
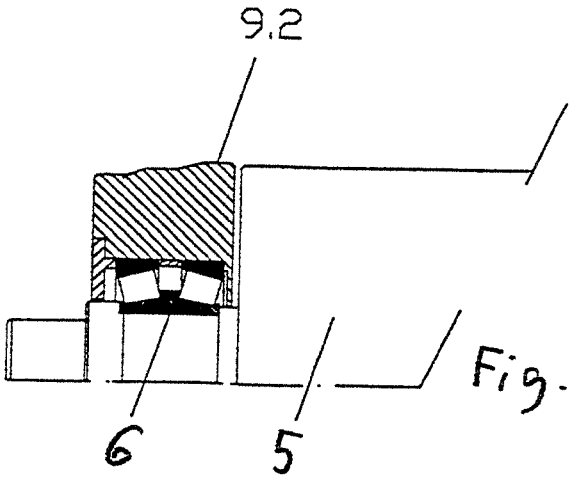
Figure 11:
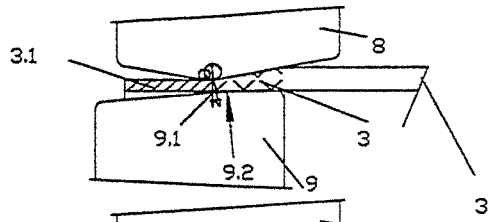
FIGS. 11-21 are a view of various phases of the shaping process based on a sample worked pieces' geometry and tool implementation.
Figure 12:
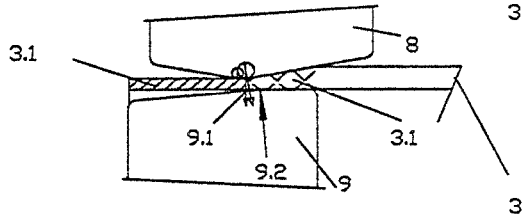
Figure 13:
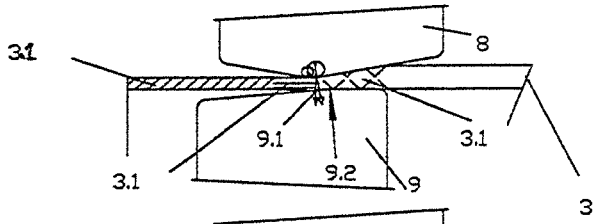
Figure 14:
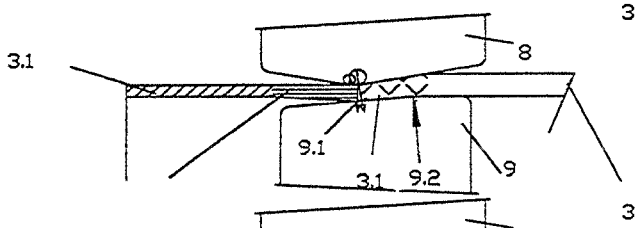
Figure 15:
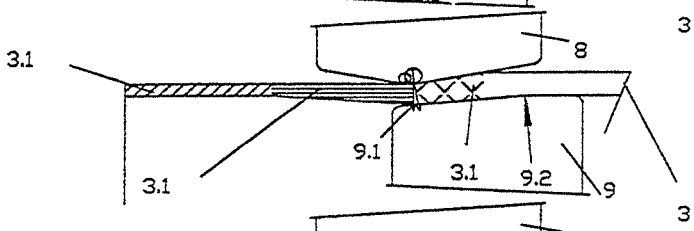
Figure 16:
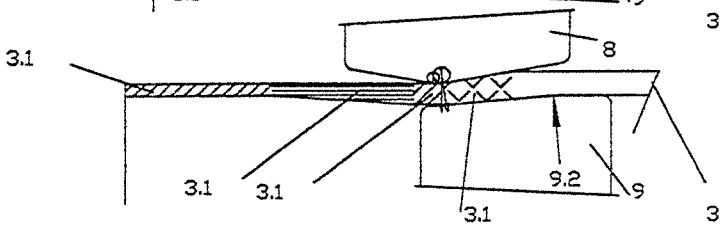
Figure 17:
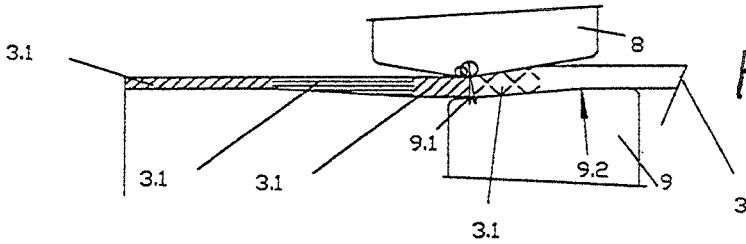
Figure 18:
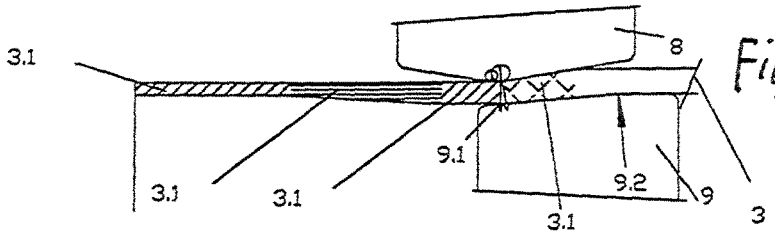
Figure 19:
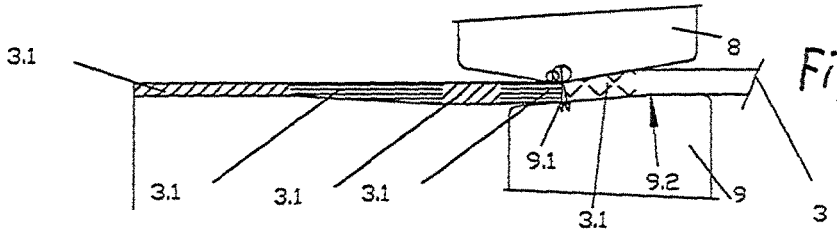
Figure 20:
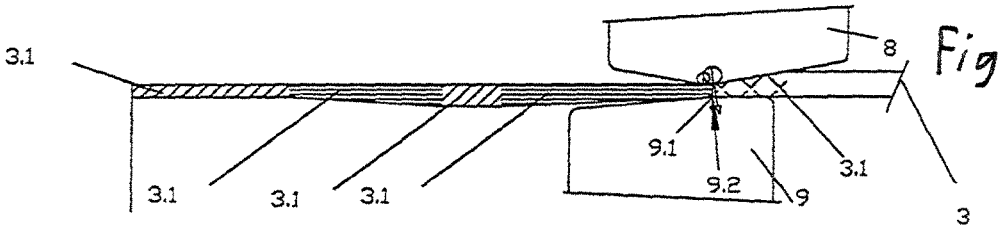
Figure 21:
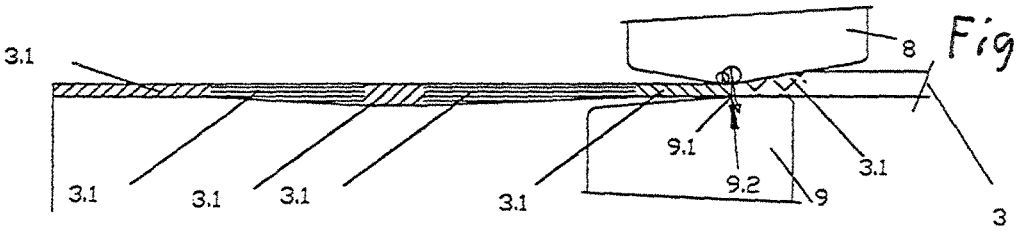
Figure 22:
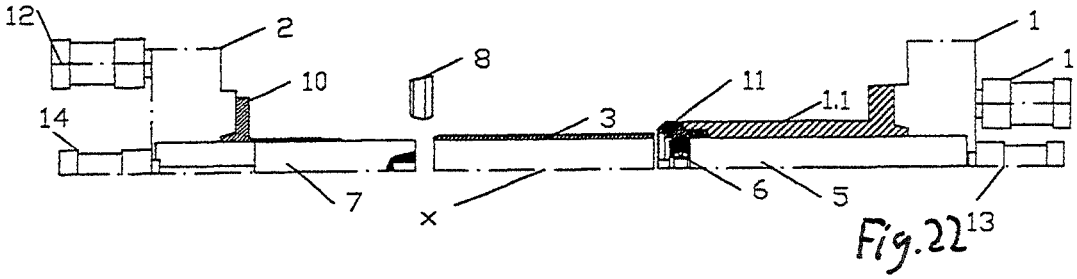
FIG. 22-26 are a view of an embodiment of the device based on the invention at various points in time of the process.
Figure 23:
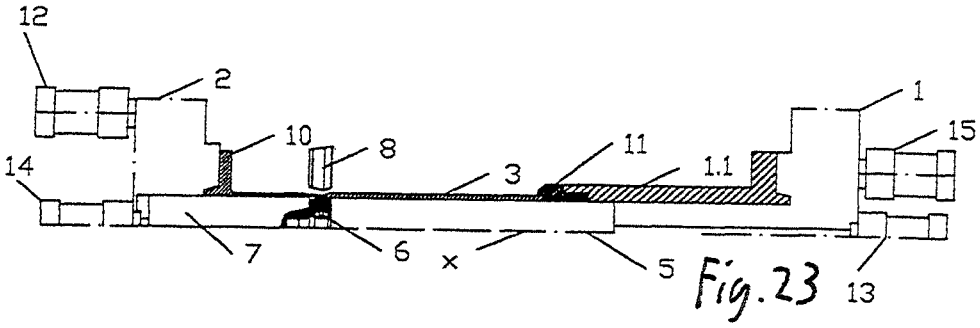
Figure 24:
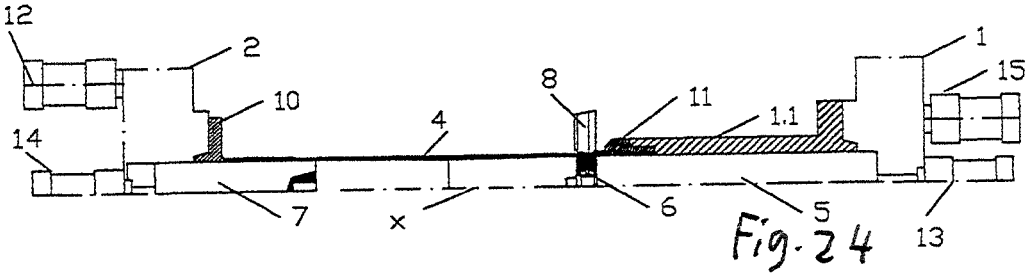
Figure 25:
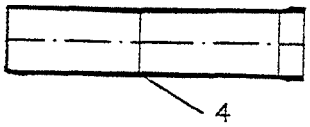
Figure 26:
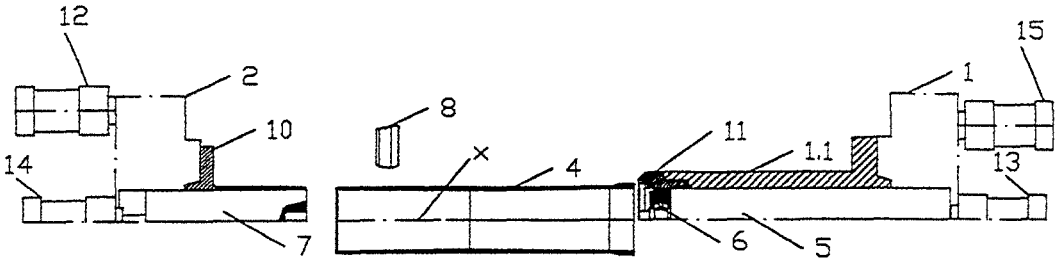
Figure 27:
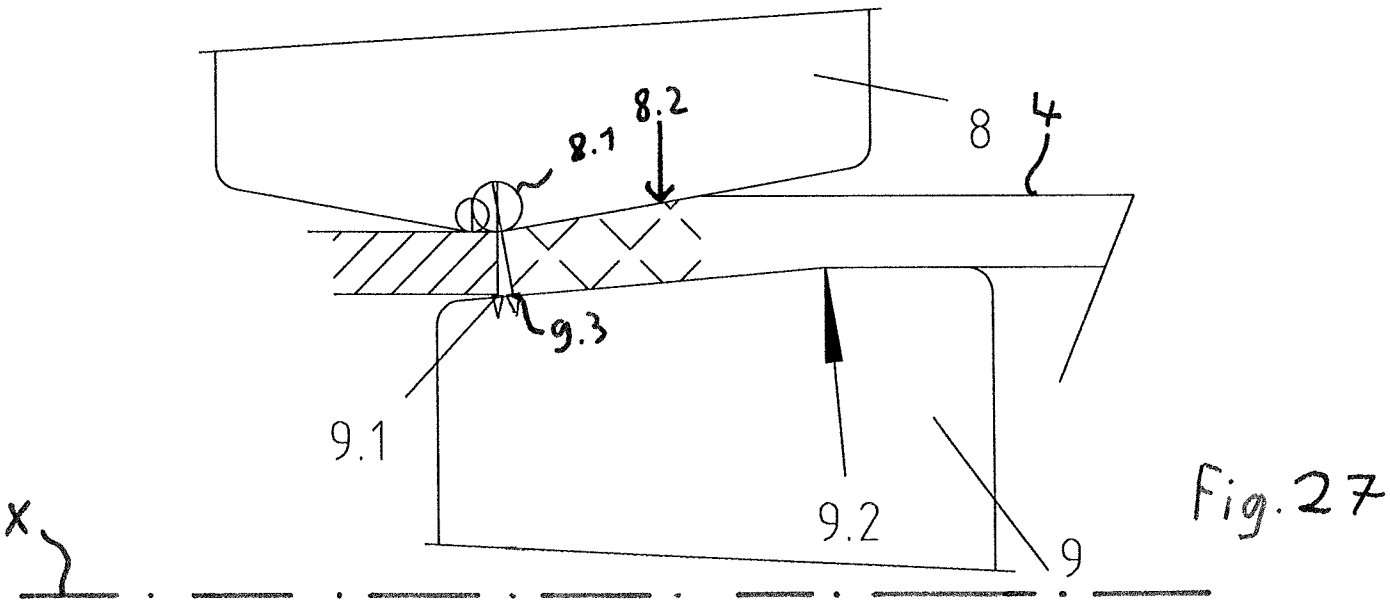
FIG. 27 is a schematic view of the formation of contact diameter at the inner shaping tool.

The inner shaping tool 9 advantageously essentially consists of an inner shaping cylinder, or possesses at least one cylinder that represents the element of the shaping tool 9 engaging the worked piece 4 from within. The exterior contour 9.2 of the inner shaping tool 9 may be cylindrical, conical, convex, or concave, depending on the requirement of the worked piece 4 to be shaped. The inner diameter of the worked piece 4 is thus determined by the contouring of the shaping tool 9. Depending on the axial position of the inner shaping tool 9 relative to the outer shaping tools 8, the shaping zone drifts in the axial direction along the surface contour of the inner shaping tool 9. The relative position may thus be selected such that an area of the outer contour always engages the shaping zone in which the effective outer diameter of the inner shaping tool 9 may be equal or slightly smaller than the desired inner diameter of the worked piece 4 at any point.

The inner shaping cylinder/tool 9 is mounted and supported by means of a bearing 6, allowing the inner shaping tool 9 to rotate about the axis x, and mounted on bracket 5 centered on the main spindle 1.1, and is infinitely displaceable in relation to the outer shaping cylinders 8 along the axis x.

If a cylindrical hollow body with constant inner diameter is to be shaped, the inner shaping cylinder 9 and outer shaping cylinders 8 may be operated in a constant axial position with respect to each other during shaping.

If, on the other hand, a hollow body with varying inner diameter is to be shaped, then the inner shaping cylinder 9 travels axially with respect to the outer shaping cylinders 8 until the desired inner diameter is achieved at the particular point of the worked piece 4.

The blank 3 may advantageously may be held centered and axial by means of a driven lathe dog 11 of the axially-displaceable main-spindle headstock 1, and may be tensioned axially, for example by means of a centering device 7 of the tailstock 2. A suitable tensioning device 14 such as preferably a pressure cylinder may be provided for this.

The outer shaping cylinders 8 may be mounted radially in a housing (not shown), and may preferably by means of CNC axes that define the radial position of the shaping tools 8 and that follow specified displacement movements. For this, the outer contour of the desired worked piece 4 results from each of the radial positions of the blank.

The quantity of possible outer shaping tools 8 results from the geometrical outer dimensions of the shaping tools with respect to the outer diameter of the worked piece 4. The maximum diameter of the inner shaping tool 9 is limited by the inner diameter of the blank.

The axial position of the outer shaping tools 8 to the inner shaping tool 9 may be determined, for example, by manual adjustment of the outer shaping tools 8 between and among the others. During shaping, these outer shaping cylinders 8 may be in fixed position axially with respect to one another, and preferably at least until the desired contouring of the worked piece 4 requires adjustment of the axial position of individual shaping tools with respect to one another during shaping.

The tensioned blank 3 may be centered by the lathe dog 11 of the main spindle 1.1 and/or by the inner shaping tool 9. Tensioning may be provided by a pressing device 14, e.g., a pressure cylinder, belonging to the tailstock. The outer shaping tools 8 may advantageously be returned to its initial position. The inner shaping tool 9 is located in the shaping position axially in the area of the outer shaping tools 8.

The unit formed by tensioning may be displaced axially into the shaping position against the pressure of the pressure device 14 by means of the advancing device 15 of the main headstock 1, which is preferably implemented as an advancing cylinder. For this, the unit may already be displaced by rotation about the main machine axis, or may become displaced by it. The inner shaping tool 9 during this may be axially in the shaping position with respect to the outer shaping cylinders 8. The outer shaping cylinders 8 may subsequently be radially displaced into the shaping position.

The headstock 1 with rotating main spindle 1.1, blank 3, and tailstock 2 may thus form a unit that may be displaced jointly by means of the axial force of the advancing device 15, which is preferably an advancing cylinder, with a regulated advance along the axial direction relative to the outer shaping tools 8.

As soon as the shaping tools 8 are in the shaping position, they may bring into radial, tangential, and axial alignment the material with wall thickness W0 of the blank 3 by means of the radial contact pressure of the outer shaping tools 8 and the resistance of the inner shaping tool 9.

The radial separation of the area 9.1 of the outer contour of the inner shaping tool 9 and of the outer contour of the worked piece 4 engaging the outer contour of the shaping tools 8 from one another determines the wall thickness W1 to be formed for the worked piece 4 to be produced within the axial position of the blank 3. During this, the desired outer diameter may be formed with the defined wall thickness W1 in this axial position. During this, the inner diameter of the worked piece 4 to be produced may be defined for each axial position of the worked piece 4 by means of the contact diameter 9.1 of the separation of the area the outer contour of the worked piece 4 engaging the inner shaping tool 9 from the main machine axis x in any given axial position.

Which area 9.3 of the outer contour 9.2 of the inner shaping tool defines the contact diameter 9.1 and thereby the inner diameter of the worked piece 4 is determined by the radial and axial position of the outer shaping tool 8 with respect to the inner shaping tool 9. The contour of the outer shaping tool 8 engaging the worked piece 4 advantageously includes a defined area 8.1 whose shape is such that between this area 8.1 and the area 9.3 of the outer contour 9.2 of the inner shaping tool 9, at which the contact diameter 9.1 results, has minimum separation between the contour 8.2 of the outer shaping tool 8 and the contour 9.2 of the inner shaping tool 9.

A resultant lengthening of the blank 3 may oppose the tailstock 2 in the alignment direction of the shaped material against the pressure of the pressure device 14, which is preferably a pressure cylinder. The contact-pressure device 14 may be configured such that the counter-pressure may be regulated or controlled. It is also possible to provide a contact-pressure extension 10 that is advantageously mounted centered with the main axis.

The outer diameter of the worked piece to be produced with wall thickness W1 is defined at each axial position of the worked piece 4 by the radial position and dimensioning of each outer shaping tool 8. The wall thickness W1 of the worked piece to be produced results at each axial position of the worked piece 4 from the contact diameter 9.1 of the inner shaping tool 9.

This contact diameter 9.1 is determined in that because of the axial position of the inner shaping tool 9 with respect to the outer shaping tools 8, a clearly-defined area of the outer contour of the inner shaping tool 9 engages with the inner contour of the worked piece 4 to be shaped. Thus, the inner diameter of the worked piece 4 to be shaped may be determined in each axial position.

If the axial position of the inner shaping tool 9 is changed with respect to the outer shaping tools 8, then the contact diameter 9.1, and thereby the defined area of the outer contour of the inner shaping tool 9 engaging with the inner contour of the worked piece 4 to be shaped are changed, with the consequence that the wall thickness W1 of the worked piece 4 to be shaped changes. For this, in the illustrated example, axial displacement of the inner shaping tool 9 with the outer contour 9.2 toward the tailstock 2 causes a smaller diameter, and displacement of the inner shaping tool 9 toward the headstock 1 causes a larger diameter. If the axial position of the shaping tool 9 relative to the outer shaping tools 8 remains fixed, the contact diameter 9.1 of the inner shaping tool 9 is a constant inner diameter.

The inner diameter is reduced if the contact diameter 9.1 is reduced, i.e., the axial position of the inner shaping tool 9 with respect to the axial position of the outer shaping tools 8 is changed such that the shaping zone on the outer contour of the inner shaping tool is displaced to an area with a smaller effective tool diameter engaging the inner contour of the worked piece 4. This allows formation of a greater wall thickness without altering the radial positions of the outer shaping cylinders 8.

On the other hand, if the outer shaping cylinders 8 also alter their radial position to a smaller-shaped outer diameter based on the inner diameter of the worked piece 4 resulting from the new relative axial position of the inner shaping tool 9 because of the outer contour of the inner shaping tool 9, then a smaller outer diameter with the same wall thickness may be shaped than before alteration of the radial position of the outer shaping cylinders 8 and the axial position of the inner shaping tool 9.

The inner diameter is increased when the contact diameter 9.1 is increased, i.e., the axial position of the inner shaping tool 9 with respect to the axial position of the outer shaping tools 8 is changed such that the shaping zone on the outer contour of the inner shaping tool is displaced to an area with a larger effective tool diameter engaging the inner contour of the worked piece 4. This allows formation of a lesser wall thickness without altering the radial positions of the outer shaping cylinders 8.

On the other hand, if the outer shaping cylinders 8 also alter their radial position to a larger-shaped outer diameter based on the inner diameter of the worked piece 4 resulting from the new relative axial position of the inner shaping tool 9 because of the outer contour of the inner shaping tool 9, then a larger outer diameter with the same wall thickness may be shaped than before alteration of the radial position of the outer shaping cylinders 8 and the axial position of the inner shaping tool 9.

The basic movements described above may be in any sequence, so that many different configurations of the above-described cylindrical or conical contour progressions 3.1 may result. Also, overlapping of the above-described basic movement progressions make possible the shaping of any conical and/or convex contours.

When the end of the blank 3 is reached, the outer shaping tools 8 may return to their initial position. Subsequently, the unit consisting of headstock, tailstock, and finished part 4 may return to the unloading position. The finished part 4 may now be released and extracted.

It is further possible that the inner shaping tool 9 possesses a shape engaging the inner contour of the worked piece 4 that makes it possible to shape the inner contour not only axially, but also along the circumferential direction. With such circumferential contouring 4.1, for example axially-extending inner ribs are possible. One possibility of implementing such an inner shaping tool would be a shaping tool, preferably a cylinder, with a surface shaped along the circumferential direction to engage the inner contour of the worked piece 4.

Based on the axial displacement capability of the inner shaping tool 9 with respect to the outer shaping tools 8, the following inner contours are possible:

1. Hollow body with or without one-sided floors, with constant outer and inner diameters;
2. Hollow body as in Item 1, but with one or more cylindrical thickenings with constant or altering outer diameter;
3. Hollow body as in Item 1, but with conical, concave, and/or convex progression of changing outer diameter;
4. Hollow body as in Items 1 through 3, but with a contouring along the circumference, e.g., axially-extending inner ribs.
5. Modifications and substitutions by one of ordinary skill in the art are considered to be within the scope of the present invention, which is not to be limited except by the allowed claims and their legal equivalents.

The invention claimed is:

1. A device for machining a workpiece (4) to be shaped consisting of a rotationally symmetrical hollow body blank (3) and a main spindle (1.1) each having an axis which is the same as a machine main axis (x), said device comprising:

at least one outer shaping tool (8) including one or more outer shaping rollers, said at least one outer shaping tool (8) configured for being radially positioned and radially moved corresponding to a predefined desired outer and inner contour of said workpiece (4) to be shaped, and further configured for being displaced in an axial direction along said machine main axis (x);

an inner shaping tool (9) which is freely rotatably fixed to a holder (5), said inner shaping tool (9) configured for being completely inserted into a central region of said workpiece (4), such that an area of an outer contour (9.2) of said inner shaping tool (9) always engages a shaping zone in which an effective outer diameter of the inner shaping tool (9) is equal to or slightly smaller than a desired inner diameter of the workpiece 4, said inner shaping tool (9) being freely rotated about said machine main axis (x) by frictional interaction with between an outer contour (9.2) of said inner shaping tool (9) and an inner surface of said workpiece (4), said inner shaping tool (9) further configured for being displaced in an axial direction along said machine main axis (x) and wherein said inner shaping tool (9) is mounted so that said inner shaping tool (9) is configured to freely rotate about and coaxially with the machine main axis (x) of the main spindle (1.1), wherein the one or more outer shaping rollers of the at least one outer shaping tool (8) are configured to engage with an outer surface of the workpiece (4) in a region of the inner shaping tool (9) from externally against said outer surface of the workpiece (4), said inner shaping tool (9) having an axial length which is less than 50% of an axial length of the workpiece (4) to be shaped, wherein the inner shaping tool (9) has an axially profiled outer contour (9.2) configured to provide different effective inner shaping tool diameters, wherein the inner shaping tool (9) is configured to be axially moved and axially positioned relative to an axial position of the at least one outer shaping tool (8) in order to predefine an axial position of the shaping zone on the inner shaping tool (9) located between the inner shaping tool (9) and the at least one outer shaping tool (8) through axial positioning of the at least one outer shaping tool (8) relative to the inner shaping tool (9) so that, due to the different effective tool diameters of the outer contour (9.2) of the inner shaping tool (9), an inner diameter of the workpiece (4) is predefined through the relative axial position of the at least one outer shaping tool (8) and the inner shaping tool (9) relative to each other;

an axially movable headstock (1) movable along said machine main axis (x), and wherein said axially movable headstock (1) includes a driven entrainment element (11) and a tailstock (2) with a receiving device formed as a centering element (7), said axially movable headstock (1) and said tailstock (2) configured to cooperate to maintain said workpiece (4) centered and axial along said machine main axis (x); and said centering element (7) comprising a tensioning device (14) with a pressure extension (10) guided centrally with respect to the machine main axis (x), wherein said tensioning device (14) with the pressure extension (10) is configured to hold the workpiece to be shaped (4) centered and braced axially along said machine main axis (x) between the driven entrainment element (11) and the centering element (7), so that the headstock (1) with rotating main spindle (1.1), the workpiece to be shaped (4) and the tailstock (2) form, due to a prestressing, one unit configured to be moved jointly through an axial force of a feed device (15) arranged on the headstock (1) with a controlled feed in the axial direction relative to the at least one outer shaping tool (8).

2. The device according to claim 1, characterised in that the inner shaping tool (9) is configured to be axially moved and axially positioned during shaping of the workpiece to be shaped (4) relative to the position of the at least one outer shaping tool (8).

3. The device according to claim 1, wherein the inner shaping tool (9) has a spherical outer contour.

4. The device according to claim 1, wherein the outer contour (9.2) of the inner shaping tool (9) has one or more cylindrical portions and one or more transitions selected from the group of transitions consisting of conical, concave and convex transitions.

5. The device according to claim 1, wherein the inner shaping tool (9) has a surface contoured in the peripheral direction engaging against the inner contour of the workpiece to be shaped (4).

6. The device according to claim 1, wherein the inner shaping tool (9) is composed of a plurality of outer profiles and outer contours.

7. The device according to claim 1, wherein the inner shaping tool (9) has at least one shaping roller which is mounted coaxially with the machine main axis (x).

* * * * *